US007322475B2

(12) United States Patent
Hassell et al.

(10) Patent No.: US 7,322,475 B2
(45) Date of Patent: Jan. 29, 2008

(54) NESTABLE CRATE FOR CONTAINERS

(75) Inventors: Jon P. Hassell, Atlanta, GA (US); William P. Apps, Alpharetta, GA (US); Robert V. Gruber, Dallas, TX (US)

(73) Assignee: Rehrig Pacific Company, Los Angeles, CA (US)

( * ) Notice: Subject to any disclaimer, the term of this patent is extended or adjusted under 35 U.S.C. 154(b) by 538 days.

(21) Appl. No.: 10/829,409

(22) Filed: Apr. 20, 2004

(65) Prior Publication Data

US 2005/0230281 A1 Oct. 20, 2005

(51) Int. Cl.
*B65D 21/02* (2006.01)
*B65D 21/032* (2006.01)
*B65D 85/30* (2006.01)

(52) U.S. Cl. ..... 206/515; 206/518; 206/519

(58) Field of Classification Search ..... 206/515, 206/507, 518, 519, 431, 505, 506
See application file for complete search history.

(56) References Cited

U.S. PATENT DOCUMENTS

| | | | | |
|---|---|---|---|---|
| D152,907 | S | | 3/1949 | Richards |
| 4,308,966 | A | * | 1/1982 | Ettema et al. ..... 220/516 |
| 4,773,554 | A | | 9/1988 | Warwick |
| 4,899,874 | A | | 2/1990 | Apps et al. |
| 4,928,841 | A | | 5/1990 | Arthurs |
| 4,978,002 | A | | 12/1990 | Apps et al. |
| D318,552 | S | | 7/1991 | Apps |
| D319,129 | S | | 8/1991 | Apps et al. |
| D320,298 | S | | 9/1991 | Apps et al. |
| 5,060,819 | A | | 10/1991 | Apps |
| D325,279 | S | | 4/1992 | Apps |
| 5,105,948 | A | * | 4/1992 | Morris et al. ..... 206/519 |
| D327,357 | S | | 6/1992 | Rehrig |
| D327,972 | S | | 7/1992 | Apps et al. |
| D329,931 | S | | 9/1992 | Apps |
| 5,184,748 | A | | 2/1993 | Apps |
| 5,230,601 | A | | 7/1993 | Apps et al. |
| 5,267,649 | A | | 12/1993 | Apps et al. |
| D343,042 | S | | 1/1994 | Apps et al. |
| 5,285,899 | A | | 2/1994 | Apps et al. |
| 5,292,001 | A | * | 3/1994 | Langenbeck et al. ..... 206/518 |
| 5,305,884 | A | | 4/1994 | Apps et al. |
| 5,316,172 | A | | 5/1994 | Apps et al. |

(Continued)

FOREIGN PATENT DOCUMENTS

| | | |
|---|---|---|
| CA | 2 351 909 A1 | 12/2001 |

(Continued)

*Primary Examiner*—Anthony D. Stashick
*Assistant Examiner*—Niki M. Eloshway

(57) ABSTRACT

A nestable bottle crate provides increased stability to the containers and improved nesting relative to prior art crates. The crate also nests and stacks with the prior art crates. The crate includes a lower wall portion and an upper band portion. The lower wall portion includes a plurality of columns and four corner columns. The upper band portion includes alternating first and second portions. The first portions are each a single, solid wall having an interior concave bottle contact surface. The second portions are aligned with the columns. The columns project inwardly farther than the second portions so that each column forms a ledge between the column and the second portion above it. The ledge is at least substantially parallel to the floor and at least substantially perpendicular to the inner wall of the second portion.

26 Claims, 8 Drawing Sheets

U.S. PATENT DOCUMENTS

| | | | | |
|---|---|---|---|---|
| 5,320,245 | A | 6/1994 | Apps et al. | |
| 5,323,925 | A | 6/1994 | Apps | |
| D356,211 | S | 3/1995 | Apps et al. | |
| D356,679 | S | 3/1995 | Apps et al. | |
| 5,405,042 | A | 4/1995 | Apps et al. | |
| 5,421,477 | A | 6/1995 | Hammett | |
| D361,431 | S | 8/1995 | Koefelda | |
| D361,663 | S | 8/1995 | Kalin | |
| 5,445,273 | A | 8/1995 | Apps | |
| 5,465,843 | A | 11/1995 | Koefelda | |
| 5,487,487 | A | 1/1996 | Hammett | |
| 5,495,945 | A | 3/1996 | Apps et al. | |
| 5,501,352 | A | 3/1996 | Apps | |
| 5,529,176 | A | 6/1996 | Apps et al. | |
| D371,239 | S | 7/1996 | Kelly | |
| D378,249 | S | 3/1997 | Apps et al. | |
| D379,121 | S | 5/1997 | Apps et al. | |
| D379,717 | S | 6/1997 | Apps et al. | |
| D380,613 | S | 7/1997 | Apps et al. | |
| D380,901 | S | 7/1997 | Apps et al. | |
| 5,651,461 | A | 7/1997 | Apps et al. | |
| 5,660,279 | A | 8/1997 | Apps et al. | |
| 5,704,482 | A | 1/1998 | Apps | |
| D398,152 | S | 9/1998 | Kelly | |
| D400,012 | S | 10/1998 | Apps | |
| 5,823,376 | A | 10/1998 | McGrath | |
| 5,842,572 | A | 12/1998 | Apps et al. | |
| D404,204 | S | 1/1999 | Apps | |
| 5,855,277 | A | 1/1999 | Apps et al. | |
| 5,913,424 | A | 6/1999 | Kelly et al. | |
| 5,918,751 | A | 7/1999 | Kelly | |
| 5,979,654 | A | 11/1999 | Apps | |
| D417,784 | S | 12/1999 | Umiker | |
| 6,006,912 | A | 12/1999 | McGrath | |
| D420,220 | S | 2/2000 | Apps et al. | |
| 6,047,844 | A | 4/2000 | McGrath | |
| 6,073,793 | A | 6/2000 | Apps et al. | |
| 6,079,554 | A | 6/2000 | Hammett et al. | |
| D441,957 | S | 5/2001 | Kelly | |
| 6,394,274 | B1 * | 5/2002 | Cheeseman | 206/511 |
| 6,749,065 | B1 | 6/2004 | Hammett | |
| 6,892,885 | B2 | 5/2005 | Apps et al. | |
| 6,899,247 | B1 * | 5/2005 | Koefelda et al. | 220/516 |
| 7,036,666 | B2 * | 5/2006 | Hammett | 206/503 |
| 2003/0070957 | A1 | 4/2003 | Apps | |

FOREIGN PATENT DOCUMENTS

| | | |
|---|---|---|
| WO | WO 01/02261 | 1/2001 |
| WO | WO 03/068610 | 8/2003 |

* cited by examiner

NESTABLE CRATE FOR CONTAINERS

BACKGROUND OF THE INVENTION

This invention relates to a nestable crate for transporting and storing containers, particularly bottles.

Bottles, particularly those used to contain soft drinks and other beverages, are often transported and stored in crates having a bottom surrounded by four sidewalls. These crates generally are configured to be stacked on top of each other both when empty and when loaded with bottles. When the crates are loaded with bottles, the floor of one crate rests on the bottles of the crate stacked below it.

A first prior art crate is tapered downwardly, such that the end walls and side walls angle inwardly toward the floor of the crate. This provides these crates with the ability to nest within one another when empty, thus conserving space when stored or shipped empty. However, this first prior art crate does not provide much lateral support for the containers to prevent the containers from tipping when additional crates are stacked on the containers.

A second prior art crate has vertical exterior surfaces from top to bottom and minimal wall stock for providing a minimal overall length and width to allow for as much bottle density and as little crate structure as possible. The bottom of these crates extends downwardly and is inwardly offset from the sidewalls to define a crate footprint. The stacking feature of such crates is typically limited to this bottom footprint, which is received within the rim of a like container to achieve a more stable stack. The second prior art crate was not designed for nesting and thus does not store efficiently when empty.

SUMMARY OF THE INVENTION

A crate according to the present invention provides increased stability to the containers and improved nesting compared with prior art crates. At the same time, the crate is also fully compatible with the prior art crates, in that it stacks and nests with the prior art crates.

The crate includes a lower wall portion and an upper band portion. The lower wall portion includes a plurality of columns and four corner columns. The upper band portion includes alternating first and second portions. The first portions are each a single, solid wall having an interior concave bottle contact surface. The second portions are aligned with the columns. The columns project inwardly farther than the second portions so that each column forms a ledge between the column and the second portion above it. The ledge is at least substantially parallel to the floor and at least substantially perpendicular to the inner wall of the second portion.

The walls and floor of the first prior art crate described above nest within the upper band portion of the present crate. The floor of the first prior art crate is supported on the ledges and corner ledges in the present crate.

The lower wall portion of the present crate also nests within the walls of the first prior art crate when stacked thereon. The upper band portion of the present crate is supported on the upper edge of the walls of the first prior art crate.

The upper band portion has approximately the same length and width as the second prior art crate described above, so that the upper band portion rests on the walls of the second prior art crate while the lower wall portion is small enough to nest within the walls of the second prior art crate when the present crate is stacked on the second prior art crate. The floor of the second prior art crate fits within the upper band portion of the present crate. Although this configuration provides almost no nesting it provides stacking that is at least as stable as would another second prior art crate.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENTS

Figure 1:
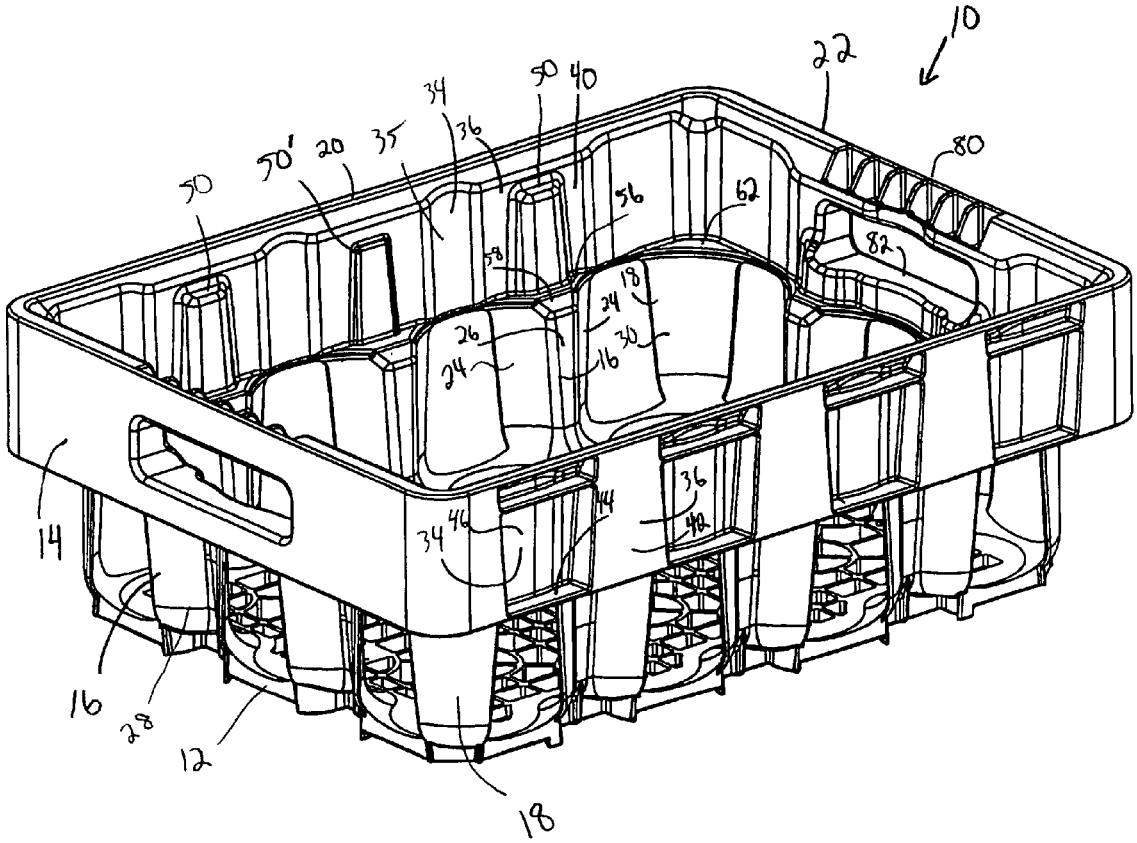
FIG. 1 is a perspective view of a nestable bottle crate according to the present invention.
Figure 2:
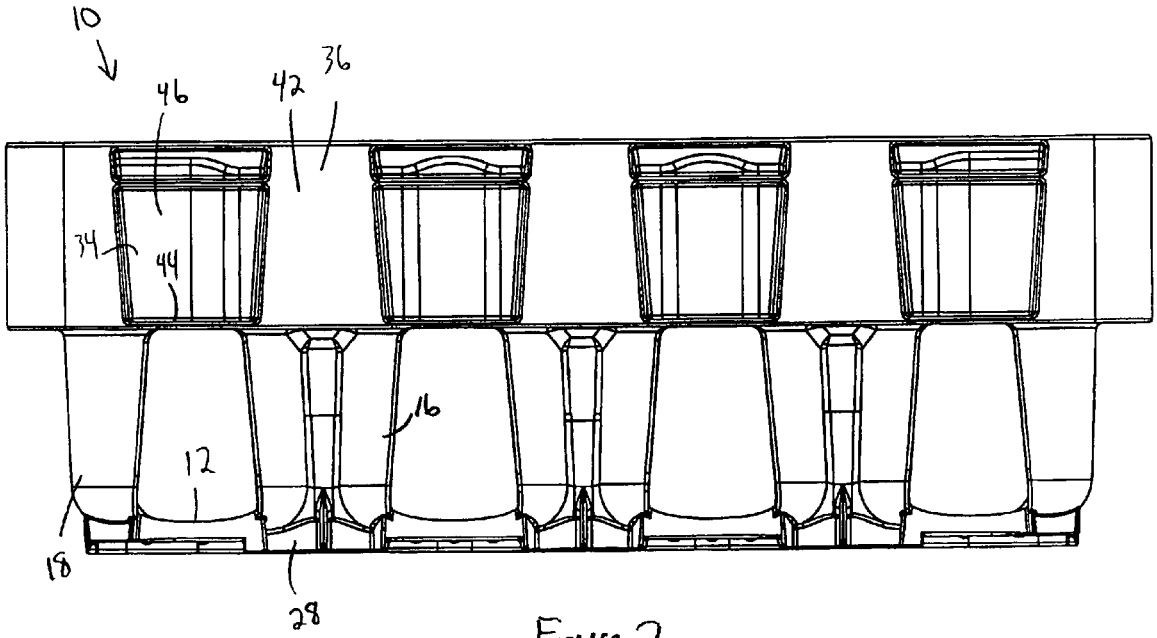
FIG. 2 is a side view of the crate of FIG. 1.
Figure 3:
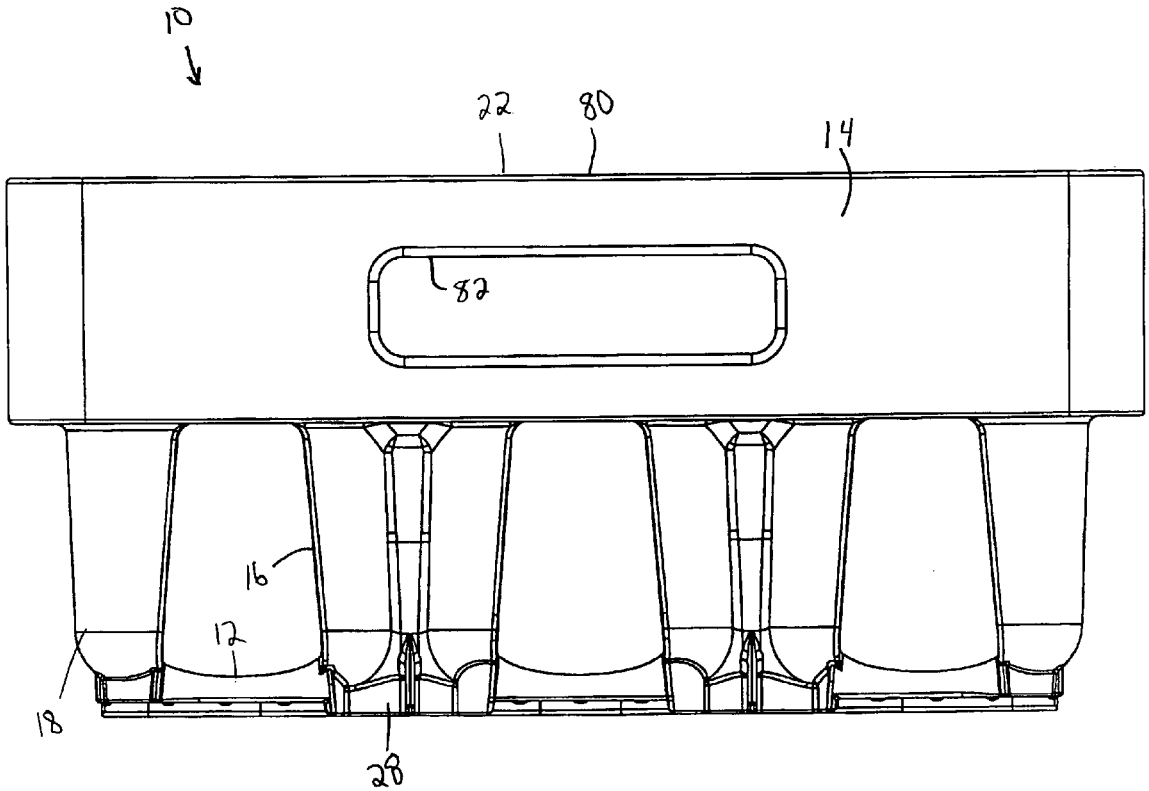
FIG. 3 is an end view of the crate of FIG. 1.

A nestable bottle crate 10 according to the present invention is shown in FIG. 1. The crate 10 includes a floor 12 up from which extends a wall structure that includes an upper band portion 14 supported above the floor 12 by a plurality of columns 16 and four corner columns 18. The upper band portion 14, columns 16 and corner columns 18 form a pair of side walls 20 and a pair of end walls 22. The columns 16 and the corner columns 18 form a lower wall portion.

Each of the columns 16 includes a pair of concave walls 24 projecting inwardly of the crate 10 to a center surface 26. The inwardly-projecting concave walls 24 of each column 16 are single, solid walls which together form a recess 28 on the exterior side of the column 16. Each corner column 18 is a single, solid wall including a concave inner surface 30.

Figure 6:
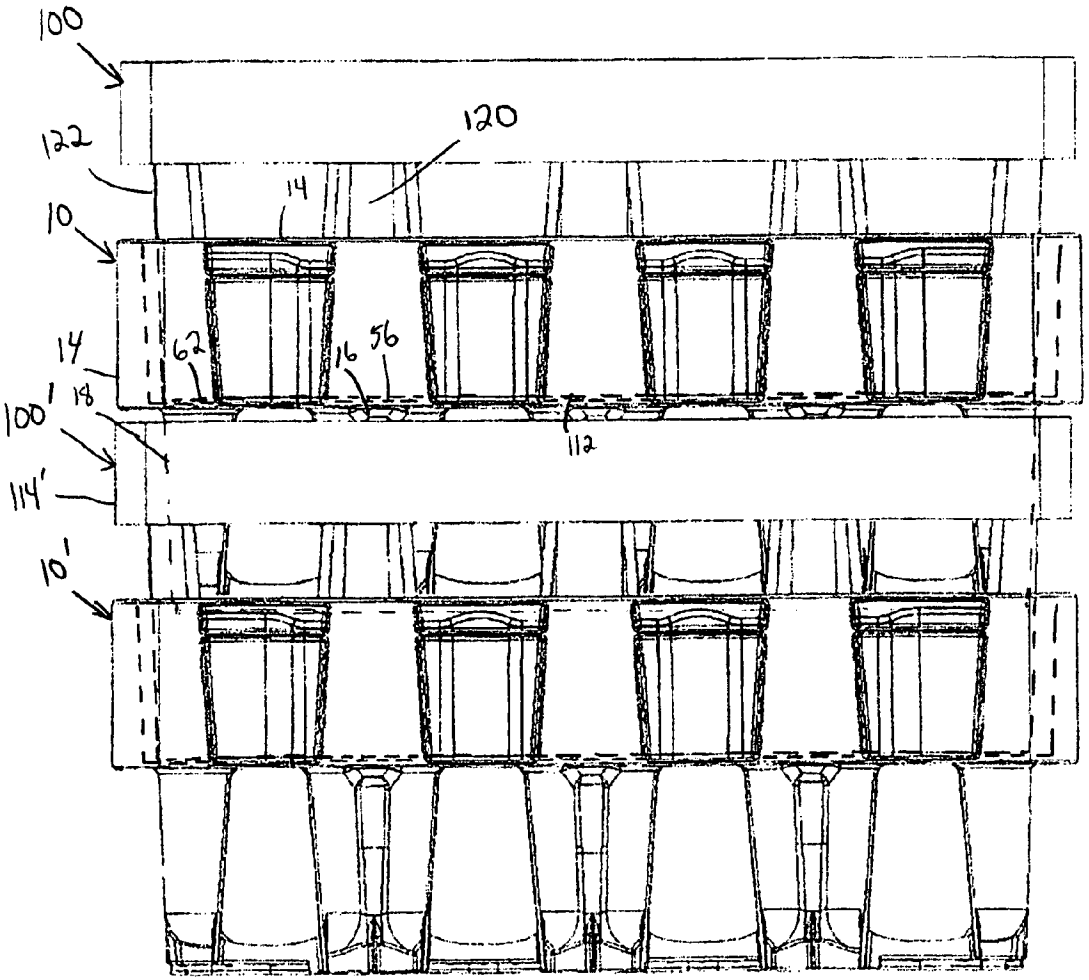
FIG. 6 is a side view of the crate of FIG. 1 in which is nested a first prior art crate, which in turn is nested in another first prior art crate, which is nested in another crate according to FIG. 1.

The upper band portion 14 includes alternating first portions 34 and second portions 36. The first portions 34 are each a single, solid wall having an interior concave bottle contact surface 35. The second portions 36 each have an inner wall 40 spaced inwardly from an outer wall 42. The first portions 34 have a lower lip 44 projecting outwardly from a lower edge of an outer surface 46. The inner wall 40 of each second portion 36 is contoured inwardly to form a nesting projection 50, although the center nesting projection 50' is shorter and projects inwardly less than the other projections 50. The nesting projections 50 provide a tighter fit with other crates nested within the crate 10. The center nesting projection 50' is smaller in order to accommodate a rib on the exterior of the first prior art crate when nested in the crate 10. (The first prior art crate 100 is shown in FIG. 6, described below, nested within the crate 10, although the rib is not visible).

The second portions 36 are aligned with the columns 16, which project inwardly farther than the second portions 36 and farther than the nesting projections 50, such that each column 16 forms a ledge 56 between each second portion 36 and the column 16 below. The ledge 56 is parallel to the floor 12 and perpendicular to the inner wall 40 of the second portion 36. Alternatively, the ledge 56 may be substantially parallel to the floor 12 and substantially perpendicular to the inner wall 40 of the second portion. A nose 58 provides a tapered surface at the juncture of the ledge 56, concave walls 24 and center surface 26.

The corner columns 18 are positioned inwardly of the corners of the upper band portion 14, thus creating corner ledges 62. The corner ledges 62 are parallel to the floor 12 and perpendicular to the upper band portion 14. Alternatively, the corner ledge 62 may be substantially parallel to the floor 12 and substantially perpendicular to the inner wall 40 of the upper band portion 14.

A handle 80 is formed in each end wall 22 to facilitate handling of the crate. An opening 82 is formed below each handle 80 to accept a user's hand while grasping the handle 80.

Figure 4:
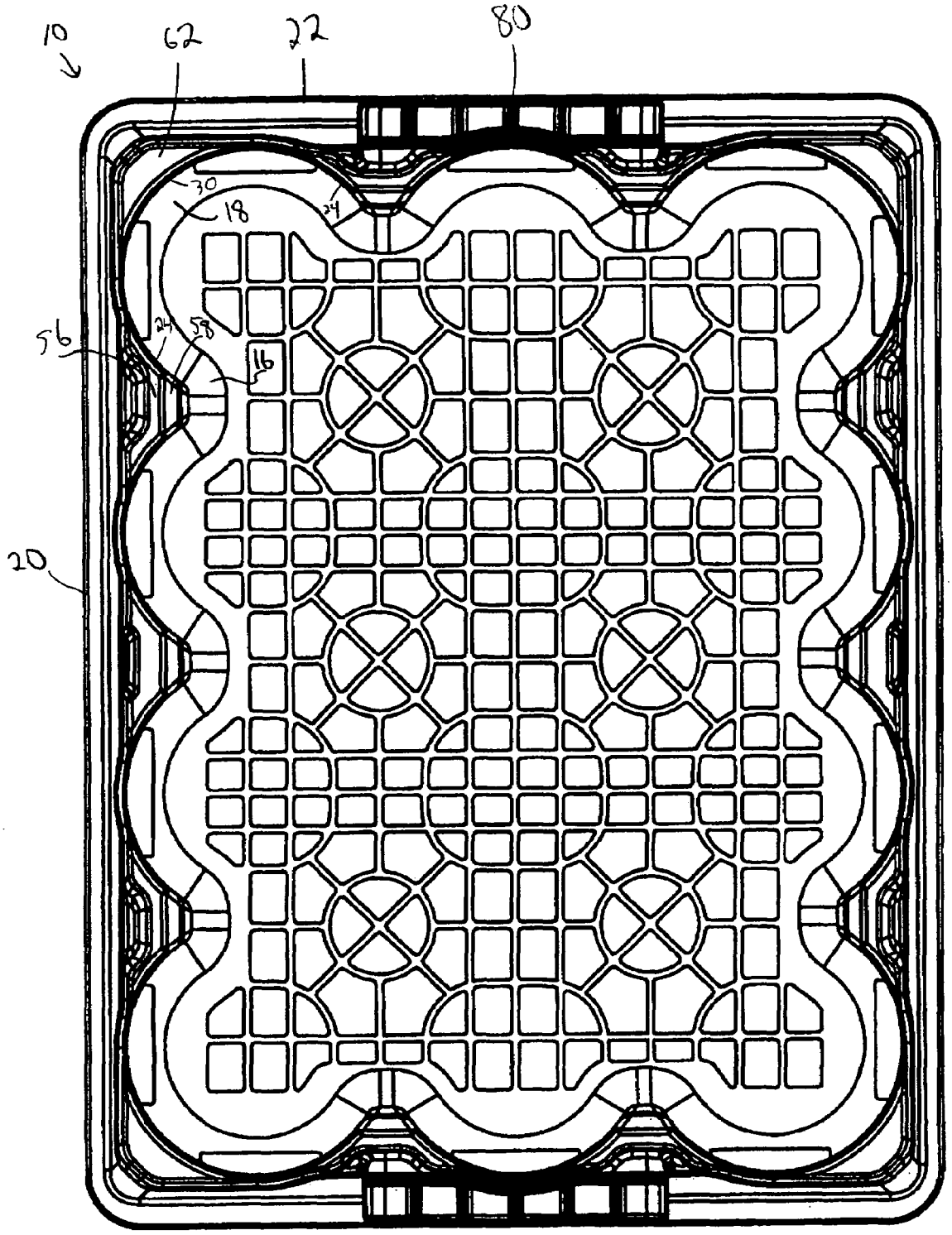
FIG. 4 is a top view of the crate of FIG. 1.

FIG. 4 illustrates a top view of the crate 10. The concave walls 24 of the columns 16, the concave inner surfaces 30 of the corner columns 18 and the upper surface of the floor 12 define bottle receiving pockets. In this case, the crate 10 includes twelve bottle receiving pockets arranged 4×3 and sized to retain one-liter bottles, but other arrangements, sizes and numbers of containers could be accommodated in the present invention.

Figure 5:
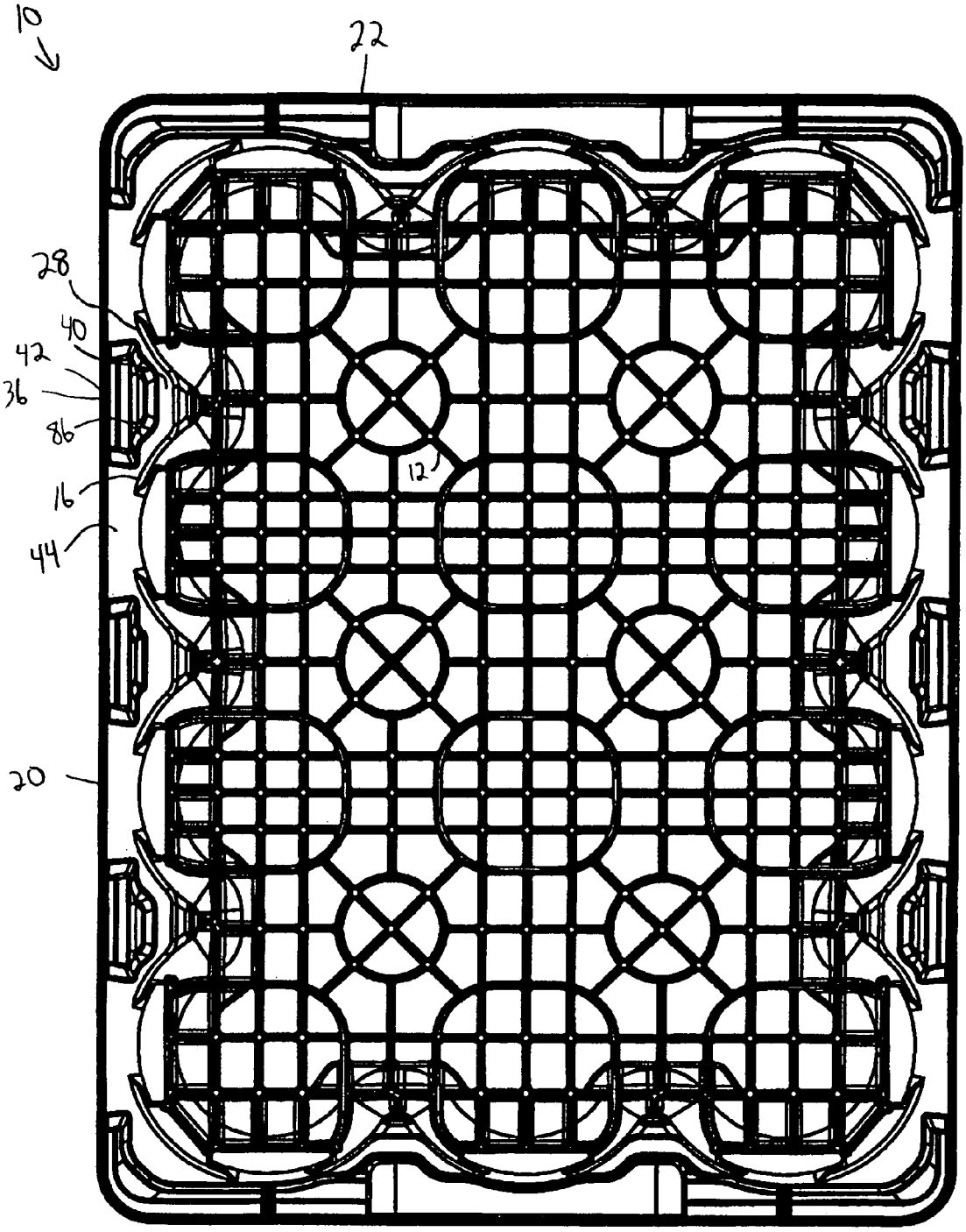
FIG. 5 is a bottom view of the crate of FIG. 1.

FIG. 5 is a bottom view of the crate 10. The second portions 36 include the inner wall 40 spaced inwardly from the outer wall 42 and defining a recess 86 therebetween that is substantially aligned with the recess 28 formed outwardly of the column 16.

FIG. 6 is a side view of the crate 10 with a first prior art crate 100 nested therein. The first prior art crate 100 is of the type shown in U.S. Pat. No. 5,495,945, which is hereby incorporated by reference in its entirety. The crate 10 is also nested in another first prior art crate 100', which in turn is nested in another crate 10'. The first prior art crate 100 is tapered downwardly, such that the end walls 122 and side walls 120 angle inwardly toward the floor 112 of the crate 100. When stacked on the present crate 10, the first prior art crate 100 partially nests within upper band portion 14 of the present crate 10. The floor 112 rests on the ledges 56 on columns 16 and on the corner ledges 62 on corner columns 18 of the crate 10. Thus, the crate 10 according to the present invention can accommodate partial nesting of the first prior art crate 100. As indicated above, the center nesting projection 50' (FIG. 1) is smaller than the other nesting projections 50 in order to accommodate a rib on the exterior of the first prior art crate 100 when nested in the crate 10. The rib corresponds to the rib referenced as numeral 91 in FIG. 1 of U.S. Pat. No. 5,495,945. As shown, the crate 10 also nests within the first prior art crate 100', such that the columns 16 and corner columns 18 nest within the first prior art crate 100'. The upper band portion 14 rests on an upper band portion 114' of the first prior art crate 100' when nested therein.

Figure 7:
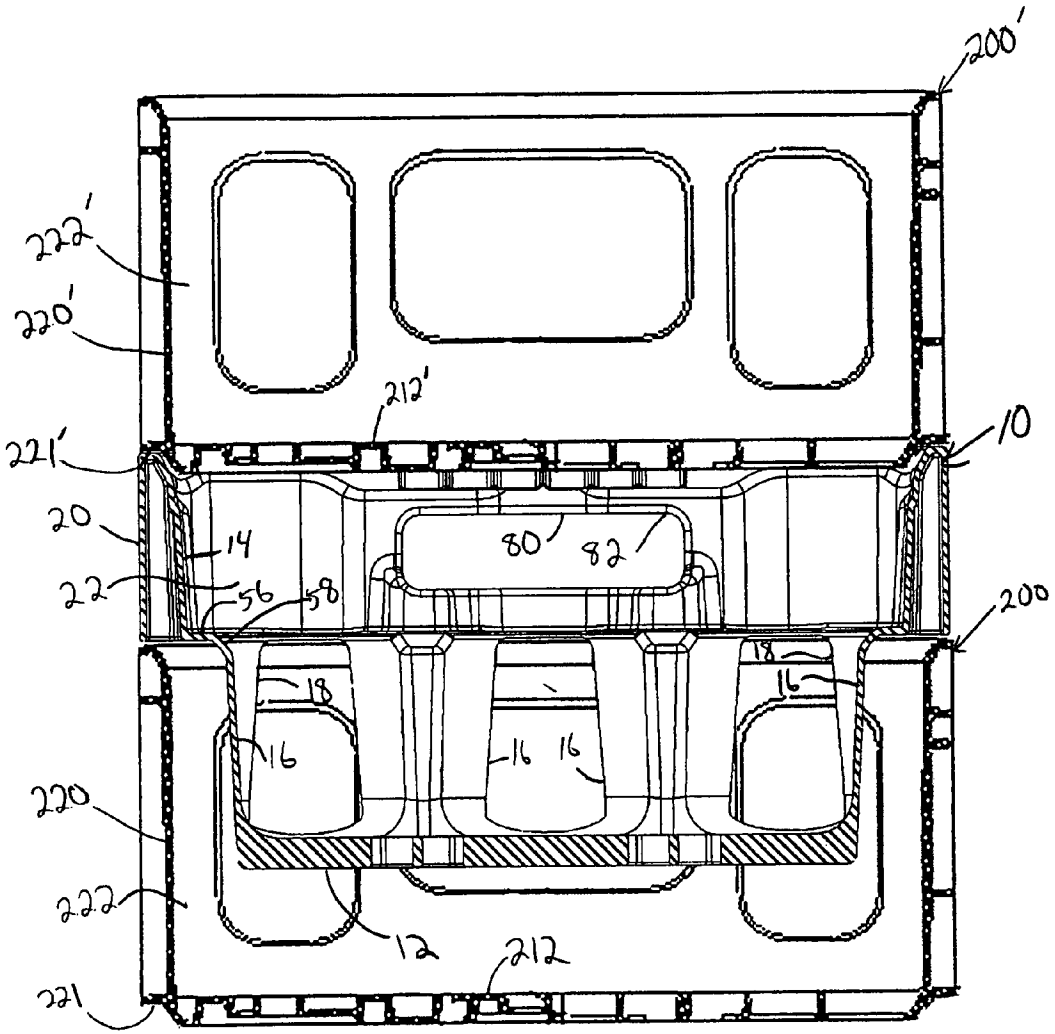
FIG. 7 is a section view of the crate of FIG. 1 which is nested in a second prior art crate, and which has nested in it another second prior art crate.

FIG. 7 is a sectional view of the present crate 10 nested in a second prior art crate 200 and with another second prior art crate 200' nested in the present crate 10. The second prior art crate 200 has side walls 220 and end walls 222 that are substantially perpendicular to the floor 212. The crate 200 is not tapered to facilitate nesting. As shown in FIG. 7, the lower wall portion (columns 16 and corner columns 18) of the present crate 10 nests within walls 220, 222 of the second prior art crate 200 when stacked thereon. The upper band portion 14, particularly the lower lips 44 of the first portions 34, of the present crate 10 rests on the walls 220, 222. The other second prior art crate 200' is similar to crate 200. The floor 212' is recessed from the outer surfaces of the end walls 222' and side walls 220' to form a lip 221' that would permit only the floor 212' of the other second prior art crate 200' to nest within the walls 220', 222' of a like crate 200 on which it is stacked or, as shown, on the present crate 10 on which it is stacked. The floor 212' of the other second prior art crate 200' nests within the walls 20, 22 of the present crate 10, with the lip 221' of the second prior art crate 200' resting on the walls 20, 22.

Figure 8:
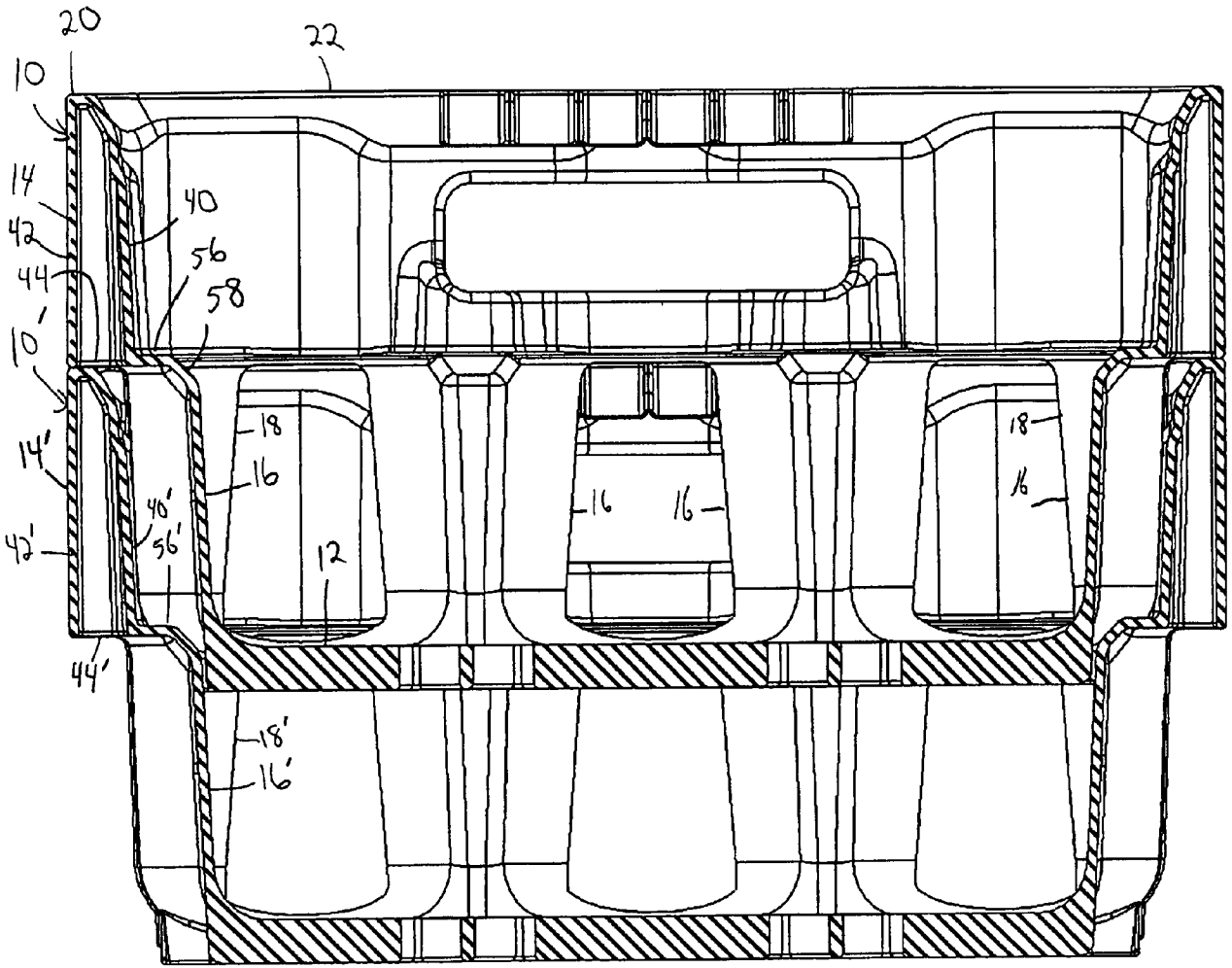
FIG. 8 is a section view of the crate of FIG. 1 nested with a similar crate.

FIG. 8 is a sectional view of the crate 10 nested with a similar crate 10'. The columns 16 and corner columns 18 nest within the upper band portion 14' of the lower crate 10' to reduce the overall height of the crates 10, 10' when empty. The upper band portion 14 of the upper crate 10 rests on the upper band portion 14' of the lower crate 10' when stacked. The columns 16' and corner columns 18' of the lower crate 10' partially nest within the columns 16 and corner columns 18 of the upper crate 10, such that the floor 12 of the upper crate 10 is below the plane defined by the ledges 56' and corner ledges 62' (not visible in FIG. 8) of the columns 16' and corner columns 18' of the lower crate 10'. Thus, the crates 10, 10' according to the present invention provide an improved degree of nesting with one another.

The crate 10 according to the present invention provides improved nesting compared to the first prior art crate 100 and the second prior art crate 200. The crate 10 also provides improved support for the bottles (or other containers) in the crate 10. Additionally, as shown above, the crate 10 is compatible with the first and second prior art crates 100, 200.

The crate 10 is preferably integrally molded as a single piece from a plastic material, such as high density polyethylene (HDPE), by an injection molding process, but other materials and processes could also be used. Although the preferred embodiment has been described as being designed for one-liter plastic bottles, other containers could also be accommodated, with appropriate modifications as would be apparent to those in the art, and still be within the scope of the present invention.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A nestable bottle crate comprising:

a floor portion having a floor upper surface, the floor upper surface including a plurality of bottle support areas for supporting bottles;

a peripherally extending upper band portion having an inner surface with bottle contact portions, the upper band portion including a plurality of first portions alternating with a plurality of second portions, the first portions each including a single solid wall having an inner surface forming the bottle contact portions, a lower lip projecting outwardly from an outer surface of each of the first portions, the second portions each including an inner wall spaced inwardly from an outer wall, an outer surface of the upper band portion including alternating recesses defined by the first portions of the upper band portion and the lower lip;

a lower wall comprising adjacent columns which extend between the upper band portion and the floor portion, the columns having inner surfaces extending inwardly into the crate, wherein the bottle contact portions, bottle support areas, and the inner surfaces of the columns define a plurality of bottle receiving pockets extending around the periphery of the crate for maintaining bottles in a vertically upright manner; and at least one ledge between the upper band portion and the lower wall, the at least one ledge protruding inwardly from the inner surface of the upper band portion between the bottle contact portions.

2. The nestable bottle crate of claim 1 wherein the inner surfaces of the columns are concave and each partially define a different one of the plurality of bottle receiving pockets.

3. The nestable bottle crate of claim 1 wherein the lower wall further includes a plurality of corner columns in corners of the crate, a corner ledge protruding inwardly from the inner surface of the upper band portion between the upper band portion and the corner ledge.

4. The nestable bottle crate of claim 1 wherein the at least one ledge is at least substantially parallel to the floor upper surface.

5. The nestable bottle crate of claim 4 wherein each corner column includes a concave inner surface partially defining one of the plurality of bottle receiving pockets.

6. The nestable bottle crate of claim 1 wherein the at least one ledge is at least substantially perpendicular to the inner surface of the upper band portion.

7. The nestable bottle crate of claim 1 wherein the lower wall further includes a plurality of corner columns in corners of the crate, a corner ledge protruding inwardly from the inner surface of the upper band portion between the upper band portion and the corner ledge, the corner ledge extending at least substantially parallel to the floor upper surface and at least substantially perpendicular to the inner surface of the upper band portion.

8. The nestable bottle crate of claim 1 wherein the lower wall and the upper band portion form two pair of opposed walls, and wherein at at least one of the pair of opposed walls all points of the lower wall are disposed inwardly of an outer surface of the upper band portion.

9. The nestable bottle crate of claim 1 wherein each column comprises a single, solid column wall connecting the upper band portion to the floor, a inner surface of the column wall at least partially defining one of the plurality of bottle receiving pockets, and an outer surface of the column wall at least partially defining an outermost surface of the lower wall.

10. The nestable bottle crate of claim 1 wherein when a like crate is stacked thereon an upper surface of a floor portion of the like crate is below a plane defined by an upper surface of the at least one ledge of the crate.

11. A nestable bottle crate comprising:

a floor having a plurality of bottle support areas for supporting bottles;

a peripherally extending upper band portion having alternating first portions and second portions, the first portions each including a single, solid wall having a bottle contact surface, the second portions each including a nesting projection, the second portions each including an inner wall spaced inwardly from an outer wall;

a lower wall comprising spaced-apart columns which extend between the second portions of the upper band portion and the floor, the columns extending inwardly into the crate, wherein the bottle contact surfaces, bottle support areas, and the columns define a plurality of bottle receiving pockets extending around the periphery of the crate for maintaining bottles in a vertically upright manner, wherein the nesting projections are received into columns of a similar crate nested in the crate; and at least one ledge generally parallel to the floor between at least one of the columns and the adjacent second portion of the upper band portion.

12. The nestable bottle crate of claim 11 wherein the at least one column is in a corner of the crate, such that the ledge is formed in the corner of the crate.

13. The nestable bottle crate of claim 11 wherein the columns include a pair of concave inner surfaces projecting inwardly into the crate, and wherein each concave inner surface partially defines one of the plurality of bottle receiving pockets.

14. The nestable bottle crate of claim 11 wherein when a like crate is stacked thereon an upper surface of a floor of the like crate is below a plane generally parallel to the floor and containing an upper surface of the at least one ledge of the crate.

15. A nestable bottle crate comprising:

a floor having a plurality of bottle support areas for supporting bottles;

a peripherally extending upper band portion having alternating first portions and second portions, the first portions having bottle contact surfaces, the second portions each including a nesting projection to provide a tighter fit with similar crates nested in the crate;

a plurality of spaced-apart columns extending from the floor to the second portions of the upper band portion, each column projecting inwardly into the crate to form a ledge between the column and the second portion of the upper band portion, a tapered nose between the ledge and the column, wherein the bottle contact surfaces, bottle support areas, and the columns define a plurality of bottle receiving pockets extending around the periphery of the crate for maintaining bottles in a vertically upright manner; and four corner columns extending from the floor to the upper band portion, each corner column projecting inwardly into the crate to form a corner ledge between the corner column and the upper band portion.

16. The nestable bottle crate of claim 15 wherein the ledges and the corner ledges are generally parallel to the floor.

17. The nestable bottle crate of claim 16 wherein the ledges are generally perpendicular to the upper band portion.

18. The nestable bottle crate of claim 17 wherein the second portions of the upper band portion each comprise an inner wall spaced inwardly from an outer wall.

19. The nestable bottle crate of claim 18 wherein the first portions of the upper band portion each comprise a single, solid wall.

20. The nestable bottle crate of claim 19 further including a recess on an exterior of the wall of each of the plurality of first portions of the upper band portion.

21. The nestable bottle crate of claim 20 wherein when a like crate is stacked thereon an upper surface of a floor of the like crate is below a plane defined by upper surfaces of the corner ledges of the crate.

22. The nestable bottle crate of claim 15 wherein one of the nesting projections is smaller than at least one of the others of the nesting projections.

23. A nestable bottle crate comprising:

a floor having a plurality of bottle support areas for supporting bottles;

a peripherally extending upper band portion having alternating first portions and second portions, the first portions each including a single, solid wall having a bottle contact surface, the second portions each including a nesting projection;

a lower wall comprising spaced-apart columns which extend between the second portions of the upper band portion and the floor, the columns extending inwardly into the crate, wherein the bottle contact surfaces, bottle support areas, and the columns define a plurality of bottle receiving pockets extending around the periphery of the crate for maintaining bottles in a vertically upright manner, wherein the nesting projections are received into columns of a similar crate nested in the crate; and at least one ledge between each of the columns and the adjacent second portions of the upper band portion, wherein when a like crate is stacked thereon an upper surface of a floor of the like crate is below a plane defined by upper surfaces of the ledges of the crate.

24. The nestable bottle crate of claim 23 wherein the at least one ledge is generally perpendicular to the upper band portion.

25. The nestable bottle crate of claim 23 wherein the second portions of the upper band portion each comprise an inner wall spaced inwardly from an outer wall.

26. The nestable bottle crate of claim 23 further including a recess on an exterior of the wall of each of the plurality of first portions of the upper band portion.

* * * * *